US011574607B2

(12) United States Patent
Sato et al.

(10) Patent No.: US 11,574,607 B2
(45) Date of Patent: Feb. 7, 2023

(54) DISPLAY DEVICE AND CONTROL METHOD OF DISPLAY DEVICE

(71) Applicant: CANON KABUSHIKI KAISHA, Tokyo (JP)

(72) Inventors: Masahiro Sato, Tokyo (JP); Hirofumi Urabe, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/149,270

(22) Filed: Jan. 14, 2021

(65) Prior Publication Data

US 2021/0225306 A1 Jul. 22, 2021

(30) Foreign Application Priority Data

Jan. 16, 2020 (JP) ..... JP2020-005072

(51) Int. Cl.
*G09G 3/36* (2006.01)

(52) U.S. Cl.
CPC ... *G09G 3/3607* (2013.01); *G09G 2320/0271* (2013.01); *G09G 2320/0626* (2013.01); *G09G 2360/16* (2013.01)

(58) Field of Classification Search
CPC ..... G09G 3/3607; G09G 5/026; G09G 5/06; G09G 2320/0271; G09G 2320/0626; G09G 2320/0673; G09G 2320/0686; G09G 2320/0247; G09G 2360/16
See application file for complete search history.

(56) References Cited

U.S. PATENT DOCUMENTS

| | | | | |
|---|---|---|---|---|
| 8,089,550 | B2 | 1/2012 | Ohyama | |
| 9,786,251 | B1 * | 10/2017 | Gordin | G09G 5/02 |
| 10,542,187 | B2 | 1/2020 | Sato et al. | |
| 2015/0154903 | A1 * | 6/2015 | Miura | G09G 3/2003 345/690 |
| 2015/0356933 | A1 * | 12/2015 | Kabe | G09G 3/3607 345/694 |
| 2018/0255207 | A1 * | 9/2018 | Sato | H04N 19/186 |
| 2019/0052853 | A1 * | 2/2019 | Yoshida | H04N 9/646 |

FOREIGN PATENT DOCUMENTS

| | | |
|---|---|---|
| JP | 2014-167609 A | 9/2014 |
| JP | 2018-073248 A | 5/2018 |

* cited by examiner

*Primary Examiner* — David Tung
(74) *Attorney, Agent, or Firm* — Cowan, Liebowitz & Latman, P.C.

(57) ABSTRACT

A display device comprising: a display; and an image obtaining unit configured to obtain an image; and a display control unit configured to perform control such that a pixel having a brightness gradation value that is included within a setting range, which is a range of brightness gradation values and which is a range set to include at least a certain number of pixels in a target frame of the image, is displayed in the display in a display appearance different from that of a pixel having a brightness gradation value that is not included within the setting range in the target frame.

14 Claims, 13 Drawing Sheets

FIG.3

| BRIGHTNESS GRADATION VALUE | NUMBER OF PIXELS |
|---|---|
| 1023 | 0 |
| 1022 | 0 |
| … | 0 |
| 741 | 0 |
| 740 | 10 |
| … | … (90) |
| 730 | 10 |
| … | 10 |
| 710 | 10 |
| 709 | 10,000 |
| 708 | 20,000 |
| 707 | 20,000 |
| … | … |
| 0 | 0 |

FIG.4A

| BRIGHTNESS(cd/m$^2$) | COLOR |
|---|---|
| 4,000～10,000 | RED |
| 2,000～4,000 | ORANGE |
| 1,000～2,000 | YELLOW |
| 400～1,000 | GREEN |
| 200～400 | INDIGO |
| 0～200 | BLUE |

FIG.4B

| BRIGHTNESS(cd/m$^2$) | COLOR |
|---|---|
| 4,000～10,000 | RED |
| 2,000～4,000 | ORANGE |
| 1,000～2,000 | YELLOW |
| 858～1,000 | GREEN |
| 0～858 | GRAY |

FIG.7

| COLORIZATION DEGREE | COLORIZATION GRADATION WIDTH α | COLORIZED PIXEL PERCENTAGE THRESHOLD |
|---|---|---|
| 5 | 30 | 10% |
| 4 | 25 | 5% |
| 3 | 20 | 3% |
| 2 | 14 | 2% |
| 1 | 12 | 1.5% |
| 0 | 10 | 1% |
| - 1 | 8 | 0.5% |
| - 2 | 6 | 0.2% |
| - 3 | 4 | 0.1% |
| - 4 | 2 | 0.05% |
| - 5 | 0 | 0.01% |

FIG.9

| BRIGHTNESS GRADATION VALUE | NUMBER OF PIXELS |
|---|---|
| 1023 | 0 |
| … | … |
| 119 | 20,000 |
| 118 | 20,000 |
| 117 | 10,000 |
| 116 | 10 |
| … | 10 |
| 74 | 10 |
| … | 10 |
| 64 | 10 |
| 63 | 0 |
| … | 0 |
| 0 | 0 |

FIG.12

| BRIGHTNESS GRADATION VALUE | NUMBER OF PIXELS |
|---|---|
| 1023 | 0 |
| … | … |
| 480 | 100 |
| 479 | 50,000 |
| … | 50,000 |
| 472 | 50,000 |
| 471 | 100 |
| … | … |
| 356 | 100 |
| 355 | 70,000 |
| … | 70,000 |
| 340 | 70,000 |
| 339 | 100 |
| … | … |
| 0 | 0 |

FIG.13

| BRIGHTNESS (cd／m²) | COLOR |
|---|---|
| 4,000～10,000 | RED |
| 2,000～4,000 | ORANGE |
| 1,000～2,000 | YELLOW |
| 400～1,000 | GREEN |
| 200～400 | INDIGO |
| 100～200 | BLUE |
| 0～100 | GRAY |

DISPLAY DEVICE AND CONTROL METHOD OF DISPLAY DEVICE

BACKGROUND OF THE INVENTION

Field of the Invention

The present invention relates to a display device and a control method of a display device.

Description of the Related Art

In recent years, there are an increasing number of cases of handling images (image signals) of a high dynamic range (HDR), which wider than a standard dynamic range (SDR).

HDR standards include perceptual quantizer (PQ), hybrid log-gamma (HLG), and the like, defined in ITU-R (radio-communication sector of ITU) BT.2100. The PQ standard implements a brightness range of from 0 to 10,000 cd/m$^2$, and can express HDR images in a wide brightness range from low brightness to high brightness.

Here, when producing an HDR image, it is important to confirm that a wide brightness range, from low brightness to high brightness, is usable. For example, there is need for managing peak brightness (maximum brightness), minimum brightness, and average brightness within a frame (a frame image). As such, display devices are available, which are provided with a function for analyzing the brightness of an image and displaying the same.

Japanese Patent Application Publication No. 2014-167609 describes a technique in which, when the dynamic range (brightness range) of a displayed image is narrower than the dynamic range of a recorded image, a zebra pattern (a stripe pattern) is displayed in a region of the recorded image where a brightness gradation value (Y value) is at least a predetermined value.

There is also need for checking regions of relatively high brightness containing peak-brightness pixels, and regions of relatively low brightness containing minimum-brightness pixels. However, with the technique of Japanese Patent Application Publication No. 2014-167609, the zebra pattern is displayed in all regions of the recorded image where the brightness gradation value is at least a predetermined value, hence, a user cannot ascertain relatively high-brightness regions or relatively low-brightness regions in the displayed image.

SUMMARY OF THE INVENTION

Accordingly, an object of the present invention is to provide a technique that enables a user to easily ascertain relatively high-brightness regions, relatively low-brightness regions, or the like in an image.

An aspect of the present invention is:

a display device comprising:

a display; and at least one memory and at least one processor which function as:

an image obtaining unit configured to obtain an image; and a display control unit configured to perform control such that a pixel having a brightness gradation value that is included within a setting range, which is a range of brightness gradation values and which is a range set to include at least a certain number of pixels in a target frame of the image, is displayed in the display in a display appearance different from that of a pixel having a brightness gradation value that is not included within the setting range in the target frame.

An aspect of the present invention is:

a display device comprising:

a display; and at least one memory and at least one processor which function as:

an image obtaining unit configured to obtain an image;

an information obtaining unit configured to obtain brightness information of a target frame of the image;

a control unit configured to, based on the brightness information, determine a setting range, which is a range of brightness gradation values and which is a range having a predetermined width; and a display control unit configured to perform control such that a pixel having a brightness gradation value that is included within the setting range in the target frame is displayed in the display in a display appearance different from that of a pixel having a brightness gradation value that is not included within the setting range in the target frame.

An aspect of the present invention is:

a display device comprising:

a display; and at least one memory and at least one processor which function as:

an image obtaining unit configured to obtain an image; and a display control unit configure to, with a number of pixels that have a brightness gradation value being at least a certain number in the target frame of the image, display in the display these pixels in a display appearance different from those of pixels having a brightness gradation value, the number of which is less than the certain number in the target frame.

An aspect of the present invention is:

a control method of a display device including a display, the method comprising:

an image obtaining step of obtaining an image; and a display step of displaying in the display a pixel having a brightness gradation value that is included within a setting range, which is a range of brightness gradation values and which is a range set to include at least a certain number of pixels in a target frame of the image in a display appearance different from that of a pixel having a brightness gradation value that is not included within the setting range in the target frame.

An aspect of the present invention is:

a control method of a display device including a display, the method comprising:

an image obtaining step of obtaining an image;

an information obtaining step of obtaining brightness information of a target frame of the image:

a control step of determining, based on the brightness information, a setting range which is a range of brightness gradation values and which is a range having a predetermined width; and a display step of displaying in the display a pixel having a brightness gradation value that is included within a setting range in the target frame in a display appearance different from that of a pixel having a brightness gradation value that is not included within the setting range in the target frame.

An aspect of the present invention is:

a control method of a display device including a display, the method comprising:

an image obtaining step obtaining an image; and a display step of displaying, with a number of pixels that have a brightness gradation value in the target frame of the image being at least a certain number, in the display, these pixels in a display appearance different from those of pixels having a brightness gradation value, the number of which is less than the certain number in the target frame.

Further features of the present invention will become apparent from the following description of exemplary embodiments with reference to the attached drawings.

BRIEF DESCRIPTION OF THE DRAWINGS

FIG. 3 is a diagram illustrating brightness distribution information according to the first embodiment, FIG. 4A is a diagram illustrating conventional correspondence relationships between brightnesses and colors, FIG. 4B is a diagram illustrating correspondence relationships between brightnesses and colors according to the first embodiment, FIG. 7 is a diagram illustrating relationships between colorization degrees, colorization gradation widths and thresholds according to the first embodiment.

FIG. 9 is a diagram illustrating brightness distribution information according to the second embodiment, FIG. 12 is a diagram illustrating brightness distribution information according to the third embodiment, and FIG. 13 is a diagram illustrating false color.

DESCRIPTION OF THE EMBODIMENTS

Assistance Functions

Figure 1:
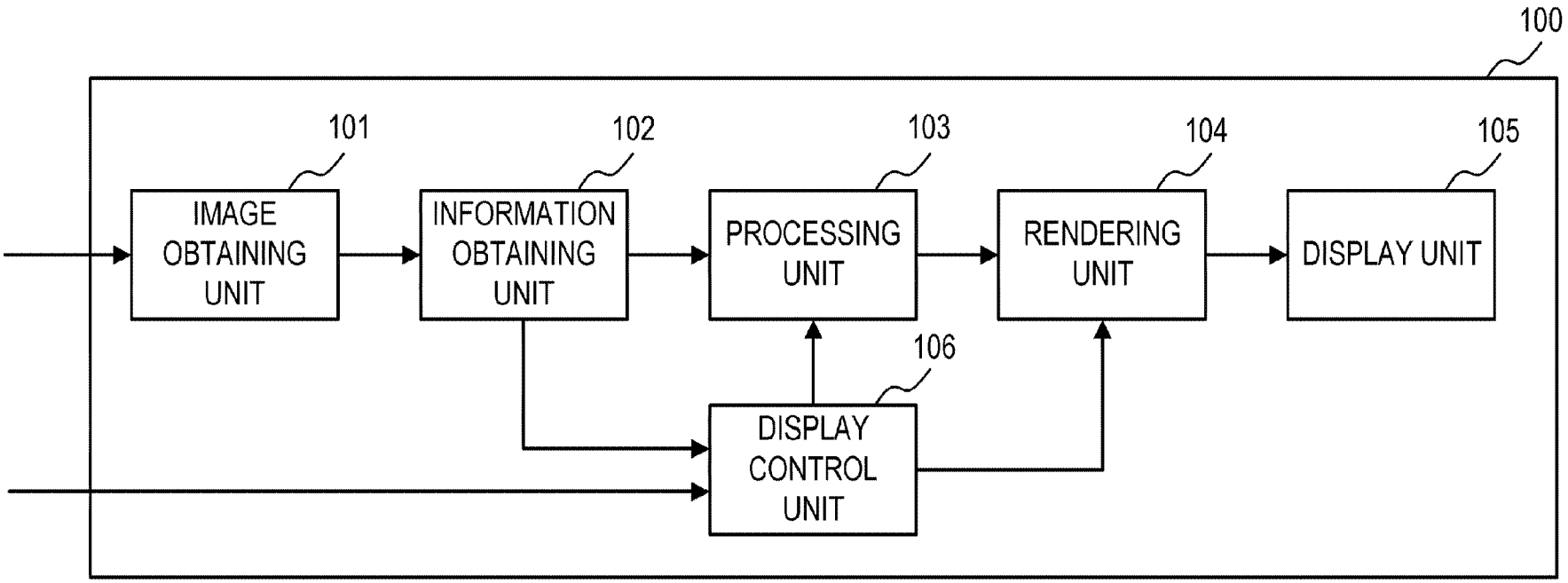
FIG. 1 is a block diagram illustrating a display device according to an embodiment.

First, before describing embodiments, assistance functions for confirming the brightness of an image will be described. These assistance functions include "zebra pattern display", "overrange", "false color", "waveform monitoring", "pixel value check", and the like. In the following, the "brightness" of an image refers to both a data brightness indicated by the data of the image, and a display brightness when the image is displayed as an HDR image (without using an assistance function). A "high-brightness region" is a region of relatively high brightness in a target image (frame). A "low-brightness region" is a region of relatively low brightness in a target image (frame). The term "colorization" refers to the addition of chromatic color.

"Zebra pattern display" is a function that displays a zebra pattern (stripe pattern) in a region constituted by pixels having at least a predetermined brightness. "Overrange" is a function that displays pixels having at least a predetermined brightness with a predetermined color such as red. "False color" is a function that displays each pixel of an image with colorization using a color based on the brightness (e.g., a function that displays the image with coloration based on a relationship between brightness and color, as indicated in FIG. 13). "Waveform monitoring" is a function that plots brightnesses on a graph where the horizontal axis represents a horizontal coordinate of an image and the vertical axis represents the brightness, and displays a distribution of the brightnesses as a waveform. "Pixel value check" is a function that displays a pixel value or a brightness of a pixel selected by a user.

Here, when creating an image, there are situations where one wishes to confirm not only one point, such as the peak brightness, but also a high-brightness region that contains peak-brightness pixels, a low-brightness region that contains minimum-brightness pixels, and the like. In such situations, these regions cannot be ascertained, or are difficult to intuitively ascertain, using the functions described above.

With the zebra pattern display, when, for example, settings are such that a region having a brightness of at least 1,000 cd/m$^2$ is displayed with a zebra pattern, regions having a brightness of from 1,000 cd/m$^2$ to 1,200 cd/m$^2$ will be displayed with the zebra pattern in a frame which has a peak brightness of 1,200 cd/m$^2$. A user can therefore ascertain high-brightness regions. However, with a frame having a peak brightness of, for example, 300 cd/m$^2$, there are no regions where the zebra pattern is displayed, and it is therefore necessary to redo the settings for the zebra pattern display. However, it is difficult for a user to change the settings to match the peak brightness that changes from frame to frame.

Like the zebra pattern display, with overrange, it is necessary for a user to change the settings to match the peak brightness in the frame, and it is therefore difficult for the user to ascertain a high-brightness region in the frame.

With false color, in a frame having a peak brightness of 1,200 cd/m$^2$, high-brightness regions are displayed in yellow, whereas pixels outside the high-brightness regions are displayed in green, indigo, blue, or the like. In a frame having a peak brightness of 300 cd/m$^2$, high-brightness regions are displayed in indigo, whereas pixels outside the high-brightness regions are displayed in blue or the like. In this manner, the high-brightness regions are displayed in different colors according to the peak brightness of the frame, and regions other than the high-brightness regions are also colorized, which makes it difficult for a user to ascertain the high-brightness regions.

With waveform monitoring, it is necessary to compare the waveform with the frame and confirm high-brightness regions in the frame on the basis of the horizontal coordinates where high brightnesses are plotted in the waveform monitor. This makes it difficult to accurately ascertain the high-brightness regions.

Finally, with the pixel value check, although the brightness of a pixel selected by a user can be known, the brightnesses of other pixels cannot, which makes it difficult for the user to ascertain the high-brightness regions.

First Embodiment

A first embodiment will describe a display device (display method; display control method) that can enable a user to easily ascertain a high-brightness region in an input image more effectively than when using assistance functions such as those described above.

Configuration of Display Device

FIG. 1 is a block diagram illustrating a display device 100 according to the present embodiment. The display device 100 includes an image obtaining unit 101, an information obtaining unit 102, a processing unit 103, a rendering unit 104, a display unit 105, and a display control unit 106.

The image obtaining unit 101 obtains an input image (image signal) from an external device such as an image capturing device or a playback device, and outputs the input image to the information obtaining unit 102. In the present embodiment, the input image obtained by the image obtaining unit 101 is a moving image having a plurality of frames. Each frame is constituted by a plurality of pixels (e.g., when the resolution is 1.920×1,080, 1,920×1,080=2,073.600 pixels). The image obtaining unit 101 includes an input terminal compliant with a standard such as SDI or high-definition multimedia interface (HDMI) (registered trademark).

The information obtaining unit 102 analyses each frame in the input image obtained from the image obtaining unit 101, and obtains a peak brightness gradation value and brightness distribution information as brightness information of each frame. Here, the "brightness gradation value" is a gradation value indicating the brightness of the input image (the Y value of YCbCr/YPbPr). The "peak brightness gradation value" is the maximum of the brightness gradation values of all the pixels in the frame. The "brightness distribution information" is information indicating a relationship between the brightness gradation value and the number of pixels. For example, when the input image is expressed by a 10-bit signal, the brightness distribution information indicates a number of pixels for each of brightness gradation values of from 0 to 1,023. Note that in the present embodiment, brightness gradation values and brightnesses are associated according to the PQ standard.

Although the brightness information is described as being obtained by analyzing the input image, the brightness information may instead be obtained from metadata added to the input image. Metadata such as dynamic metadata including peak brightness information for each frame, as defined by SMPTE ST2094, can be used as the metadata.

The information obtaining unit 102 outputs the brightness information to the display control unit 106. The information obtaining unit 102 also outputs the input image to the processing unit 103.

When a colorization setting is set to "off", the processing unit 103 performs image processing on the input image obtained from the information obtaining unit 102, and outputs the post-image processing image to the rendering unit 104. Here, "colorization setting" is a setting indicating whether or not to display the input image in a colorized state in accordance with the brightness of each pixel (the brightness gradation value). If the colorization setting is "on", the display device 100 displays the input image in a colorized state. If the colorization setting is "off", the display device 100 displays the input image without such colorization. Note that the colorization setting can be set by a user in advance. The colorization setting is stored in, for example, a recording unit (not shown).

When, for example, the colorization setting is "off", the processing unit 103 converts the obtained input image (image signal) into an image (image signal) of a format for display in the display unit 105. When the colorization setting is "on", the processing unit 103 outputs the input image to the rendering unit 104 without processing the image. The conversion performed by the processing unit 103 is performed on the basis of electro-optical transfer function (EOTF) settings, such as PQ, HLG, or Gamma 2.2, which are set from the display control unit 106, for example. The conversion performed by the processing unit 103 may be performed on the basis of color gamut settings such as ITU-R BT.709 or ITU-R BT.2020, signal range settings such as limited range and full range, or the like. Note that in the present embodiment, as the image processing, the processing unit 103 performs processing for converting the input image according to the PQ standard.

When the colorization setting is set to "off", the rendering unit 104 performs colorization processing (rendering processing) on the input image obtained from the processing unit 103, and outputs the post-colorization processing image to the display unit 105. When the colorization setting is "off", the image obtained from the processing unit 103 is output to the display unit 105 without performing the colorization processing. The colorization processing is performed on the basis of a three-dimensional look-up table (3D-LUT) set from the display control unit 106. In the present embodiment, the user can ascertain high-brightness regions in the input image as a result of the rendering unit 104 performing the colorization processing based on the 3D-LUT. Note that the user may be enabled to ascertain the high-brightness regions by the rendering unit 104 displaying the high-brightness regions with a predetermined pattern, such as a zebra pattern or a pattern (graphic) in which multiple figures are arranged.

The display unit 105 includes a backlight and a liquid crystal panel. The display unit 105 displays the image obtained from the rendering unit 104 in the liquid crystal panel. Note that the display unit 105 is not limited to displaying the image in a liquid crystal panel, and may instead display the image in an organic EL panel, an LED panel, or the like, or may project the image onto a screen.

The display control unit 106 controls the various blocks of the display device 100 by executing a program stored in non-volatile memory. Additionally, the display control unit 106 accepts user operations made through buttons and the like provided in a housing of the display device 100. The display control unit 106 can also set EOTF settings, color gamut settings, and signal range settings, which have been set through user operations, in the processing unit 103.

When the colorization setting has been set to "on" through a user operation, the display control unit 106 calculates a 3D-LUT on the basis of the brightness information obtained from the information obtaining unit 102. The display control unit 106 outputs the calculated 3D-LUT to the rendering unit 104. Note that when the colorization setting is set to "on", the rendering unit 104 performs the colorization processing in accordance with the brightness gradation values in the input image, and thus the display control unit 106 instructs the processing unit 103 not to perform image processing.

3D-LUT Generation Processing

Figure 2:
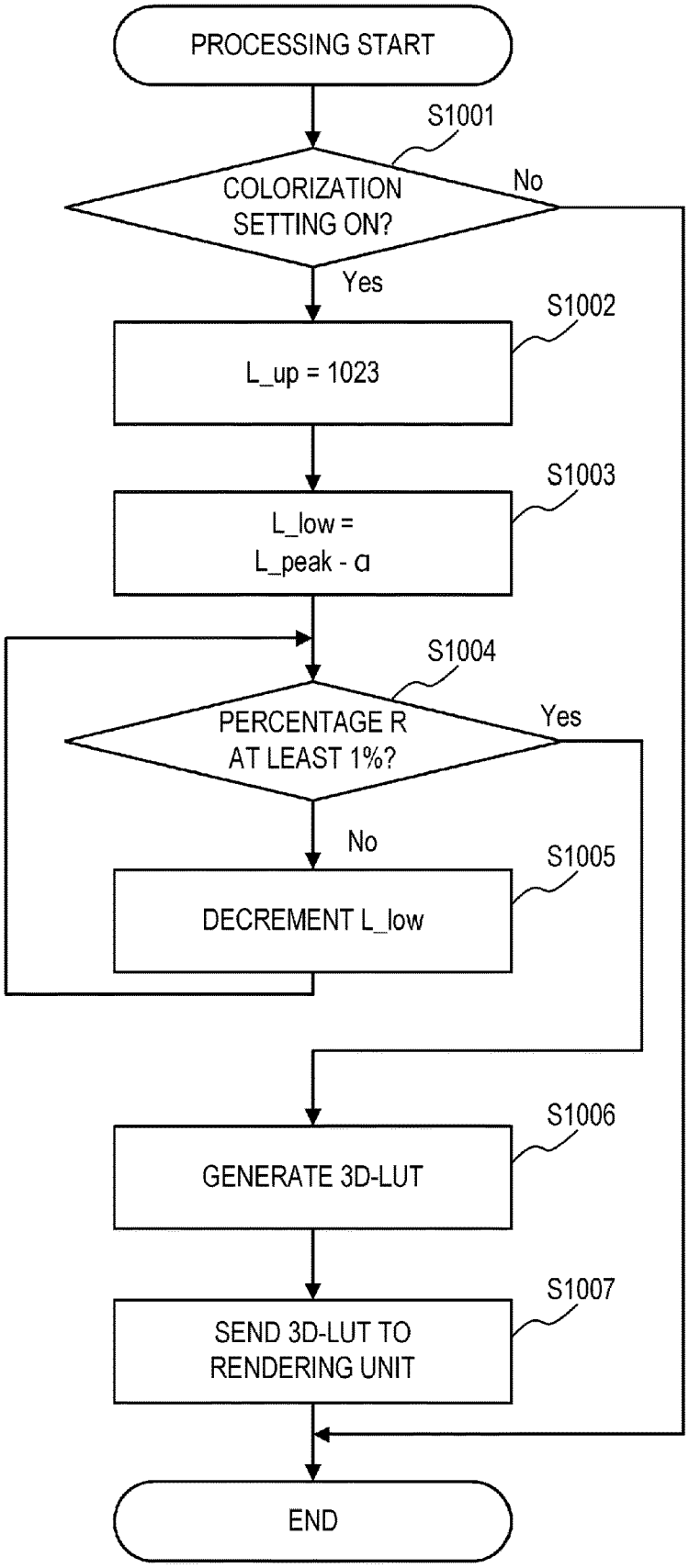
FIG. 2 is a flowchart illustrating processing for generating a 3D-LUT according to a first embodiment.

Processing through which the display control unit 106 generates the 3D-LUT will be described hereinafter with reference to the flowchart in FIG. 2. Note that the display control unit 106 executes the respective steps of the processing in the flowchart illustrated in FIG. 2 by executing programs recorded into non-volatile memory (not shown). Although the following will describe only processing for generating a 3D-LUT for a single frame of the input image (called a"target frame" hereinafter), the processing of the flowchart illustrated in FIG. 2 is performed on each frame of the input image. The processing of the flowchart illustrated in FIG. 2 starts upon the display control unit 106 obtaining, from the information obtaining unit 102, the peak brightness gradation value and the brightness distribution information of the target frame.

In S1001, the display control unit 106 obtains, from the recording unit, the colorization setting set through a user operation, and determines whether the colorization setting is "on" or "off". When the colorization setting is "on", the sequence moves to S1002, whereas when the colorization setting is "off", the processing of the flowchart ends.

In S1002 to S1005, the display control unit 106 sets a colorization brightness range (setting range). Specifically, the display control unit 106 sets a range from a lower limit value of the brightness gradation value of a pixel to be colorized (a lower limit brightness gradation value L_low) to an upper limit value of the brightness gradation value of the pixel (an upper limit brightness gradation value L_up) as the colorization brightness range for the target frame of the input image.

In S1002, the display control unit 106 sets the upper limit brightness gradation value L_up to 1,023.

In S1003, the display control unit 106 determines the lower limit brightness gradation value L_low on the basis of a peak brightness gradation value L_peak obtained from the information obtaining unit 102. In S1003, the display control unit 106 determines a value obtained by subtracting a colorization gradation width α from the peak brightness gradation value L_peak as the lower limit brightness gradation value L_low. The "colorization gradation width α" is a gradation width from the peak brightness gradation value L_peak. Although a fixed value in the present embodiment, the colorization gradation width α can be set as desired by the user.

Here, determining the colorization gradation width α in advance ensures that pixels up to a gradation value obtained by subtracting the colorization gradation width α from the peak brightness gradation value L_peak will always be colorized. In other words, even if there are a large number of pixels having the peak brightness gradation value L_peak, even pixels having gradation values near the peak brightness gradation value L_peak (high-brightness regions) can be colorized reliably. Accordingly, the user can ascertain not only the pixels having the peak brightness gradation value L_peak, but also regions of pixels near the peak brightness gradation value L_peak (high-brightness regions).

For example, when the peak brightness gradation value L_peak is 740 and the colorization gradation width α is 10, the lower limit brightness gradation value L_low can be determined to be 730, through the following Equation 1.

$$L_low = L_peak - \alpha = 740 - 10 = 730 \quad \text{Equation 1}$$

In S1004, on the basis of the upper limit brightness gradation value L_up, the lower limit brightness gradation value L_low, and the brightness distribution information, the display control unit 106 determines whether or not a percentage R of a number of colorized pixels out of the total number of pixels in the target frame is at least 1% (a value desired by the user). The sequence moves to S1006 when the percentage R is at least 1%. However, the sequence moves to S1005 when the percentage R is not at least 1%.

When, for example, the resolution of the input image is a resolution of 1,920×1,080, the total number of pixels in the target frame is 1,920×1,080=2,073,600 pixels. The total number of pixels in the target frame may be calculated by adding together the number of pixels of each brightness gradation value on the basis of the brightness distribution information.

On the other hand, the number of colorized pixels can be calculated from the upper limit brightness gradation value L_up, the lower limit brightness gradation value L_low, and the brightness distribution information. For example, when the upper limit brightness gradation value L_up is 1,023 and the lower limit brightness gradation value L_low is 730, the number of colorized pixels is the total number of pixels having brightness gradation values of 730 to 1,023 (which can be determined from the brightness distribution information). Specifically, with the brightness distribution illustrated in FIG. 3, the number of colorized pixels is 110. Note that because the percentage R is calculated as (110/2,073,600)× 1000.0053%, the percentage R is not at least 1%.

In S1005, the display control unit 106 decrements the lower limit brightness gradation value L_low by 1, i.e., reduces the value by 1.

In other words, through the processing of S1004 and S1005, the lower limit brightness gradation value L_low is decremented until the percentage R becomes at least 1%. In the example illustrated in FIG. 3, the percentage R of colorized pixels becomes at least 1% at the point where the lower limit brightness gradation value L_low becomes 708. As such, through the processing of S1002 to S1005, the lower limit brightness gradation value L_low is determined as 708, and the upper limit brightness gradation value L_up is determined as 1,023. In other words, the lower limit brightness gradation value L_low and the upper limit brightness gradation value L_up are finalized, and the colorization brightness range is set, at the point in time ben the sequence moves to S1006.

In the brightness distribution illustrated in FIG. 3, there are only a few pixels near the peak brightness. As such, when pixels having brightness gradation values between the peak brightness gradation value L_peak of 740 and the lower limit brightness gradation value L_low of 730 calculated from the colorization gradation width α of 10 are colorized, only a small area of 110 pixels (0.0053% of the total) are colorized. This makes it difficult to see the high-brightness regions. However, by having the display control unit 106 set the percentage R of colorized pixels to at least a predetermined percentage as in the present embodiment, the high-brightness regions in the frame can be made easier to see.

In S1006, the display control unit 106 generates a 3D-LUT on the basis of the lower limit brightness gradation value L_low and the upper limit brightness gradation value L_up. In S1006, the display control unit 106 generates a 3D-LUT for converting the colors of pixels having brightness gradation values not within the colorization brightness range into monochromatic values and converting the colors of pixels having brightness gradation values within the colorization brightness range into brightnesses corresponding to those brightness gradation values.

FIG. 4A illustrates an example of correspondence relationships between brightnesses and colors when performing a display using false colors, as in the past. As opposed to this, in the present embodiment, a 3D-LUT such as that illustrated in FIG. 4B is generated, on the basis of the correspondence relationships illustrated in FIG. 4A, so that pixels having brightnesses (brightnesses of 0 to 858 cd/m$^2$) corresponding to brightness gradation values outside the range of the colorization brightness range (brightness gradation values from 708 to 1,023) are displayed with monochromatic values. In other words, using the 3D-LUT, the colors of pixels having brightnesses of at least 0 cd/m$^2$ and not more than 858 cd/m$^2$ are converted to gray (achromatic), while the colors of pixels having brightnesses higher than 858 cd/m$^2$ and not more than 1,000 cd/m$^2$ are converted to green. The colors of pixels having brightnesses higher than 1,000 cd/m$^2$ and not more than 2,000 cd/m$^2$ are converted to yellow. The colors of pixels having brightnesses higher than 2,000 cd/m$^2$ and not more than 4,000 cd/m$^2$ are converted to orange. The colors of pixels having brightnesses higher than 4,000 cd/m$^2$ and not more than 10,000 cd/m$^2$ are converted to red.

Note that in the brightness distribution illustrated in FIG. 3, the peak brightness gradation value L_peak is 740, and the peak brightness gradation value is 1,200 cd/m$^2$ as an equivalent brightness. As such, there are no pixels having a brightness exceeding 2,000 cd/m$^2$ in the frame, and therefore no pixels colorized with orange or red.

By having the display control unit 106 generate the 3D-LUT in this manner, the display unit 105 can, in a target frame, display pixels having brightness gradation values within a colorization brightness range in a different display appearance from pixels having brightness gradation values which are not within the colorization brightness range.

Figure 5A:
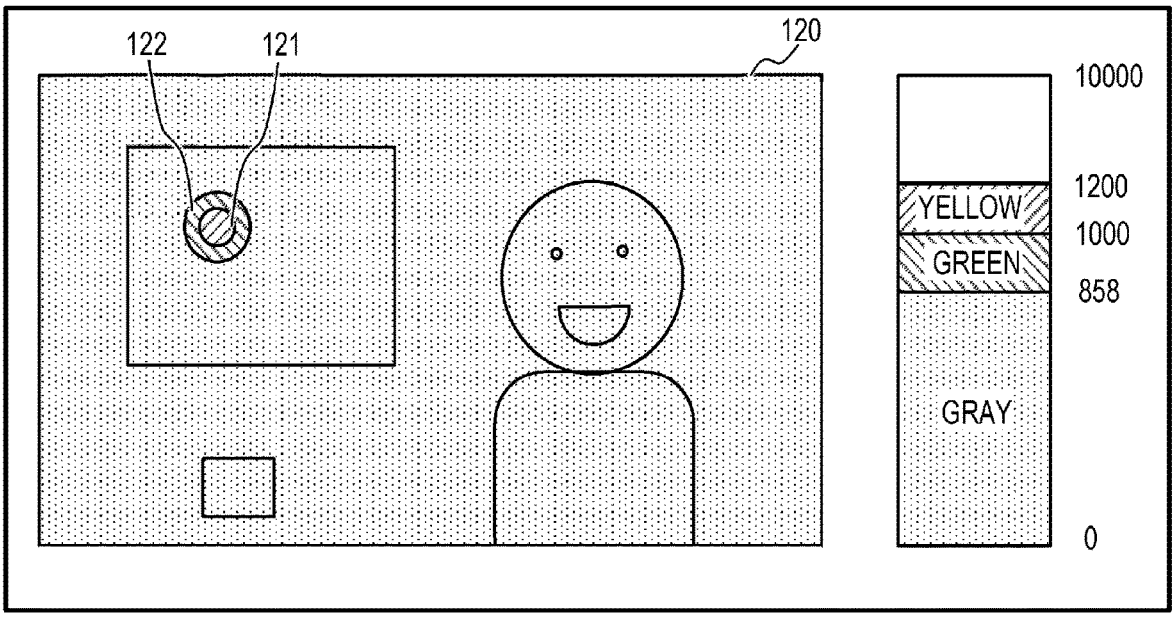
FIGS. 5A and 5B are diagrams illustrating a display image according to the first embodiment.

In S1007, the display control unit 106 outputs the generated 3D-LUT to the rendering unit 104. Then, the rendering unit 104 performs the colorization processing on the target frame of the input image according to the brightness gradation values (brightnesses), and a display image 120 such as that illustrated in FIG. 5A is displayed in the display unit 105.

A region 121 in the display image 120 is a region of pixels having brightnesses higher than 1,000 cd/m$^2$ and not more than 1,200 cd/m$^2$, and is displayed in yellow. A region 122 is a region of pixels having brightnesses higher than 858 cd/m$^2$ and not more than 1,000 cd/m$^2$, and is displayed in green. The pixels in other regions are pixels having brightnesses not more than 858 cd/m$^2$ and are therefore displayed in gray (achromatic). In this manner, only the brightest 1% of pixels in a frame are colorized with a given chromatic color, and furthermore, pixels having high brightnesses are colorized with different chromatic colors according to the brightnesses of those pixels.

Thus according to the present embodiment, the colorization brightness range is calculated on a frame-by-frame basis, and thus an image in which high-brightness pixels occupying at least a set surface area between frames are colorized.

Effects

As described thus far, by calculating the colorization brightness range on the basis of the peak brightness information and the brightness distribution information of a frame in the input image, and performing the colorization processing with a chromatic color only for high-brightness pixels in the frame, the user can intuitively ascertain high-brightness regions.

Furthermore, the percentage of colorized pixels is at least a predetermined percentage even in frames where few pixels have brightnesses near the peak brightness, and the user can therefore easily see the high-brightness regions within the frame.

Although the present embodiment describes the upper limit brightness gradation value L_up of the colorization brightness range being set to 1,023, the upper limit brightness gradation value L_up may be any desired value that is at least the peak brightness gradation value L_peak (at least the peak brightness gradation value) and not more than 1,023.

Figure 5B:
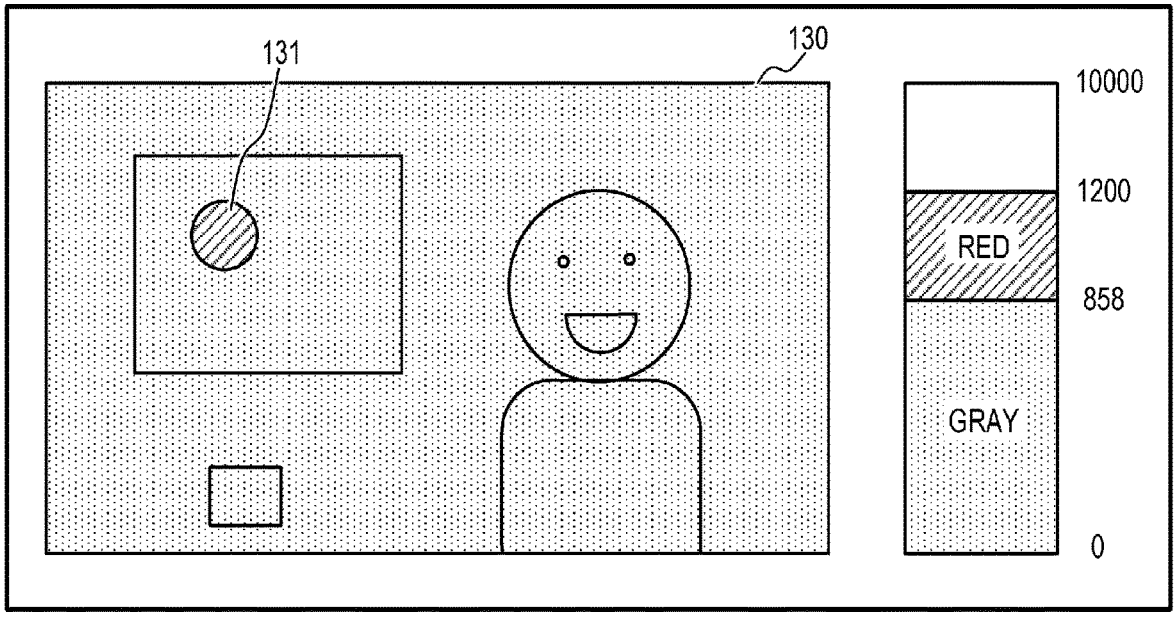

Additionally, although the present embodiment describes the color of pixels having brightness gradation values within the colorization brightness range as being converted into colors according to the brightness on the basis of the correspondence relationships between brightnesses and colors, it is also possible to display all pixels having brightness gradation values within the colorization brightness range in a predetermined color such as red. FIG. 5B illustrates an example of the display when pixels having brightness gradation values within the colorization brightness range are displayed in red. In a display image 130, a region 131 is a region of pixels having brightnesses of 858 to 1,200 cd/m$^2$, which corresponds to brightness gradation values within the colorization brightness range, and these pixels are displayed in red. Regions aside from the region 131 are displayed in gray. Note that the brightnesses of the pixels after the colorization may or may not be a predetermined brightness. For example, a brightness based on the brightness in the input image (e.g., the same brightness as the brightness of the input image) may be used for the brightness of the pixels after the colorization. Additionally, the brightness of the colorized pixels may be a predetermined brightness, while the uncolorized pixels may be displayed in an achromatic color (monochromatic) based on the brightness in the input image.

Figure 6:
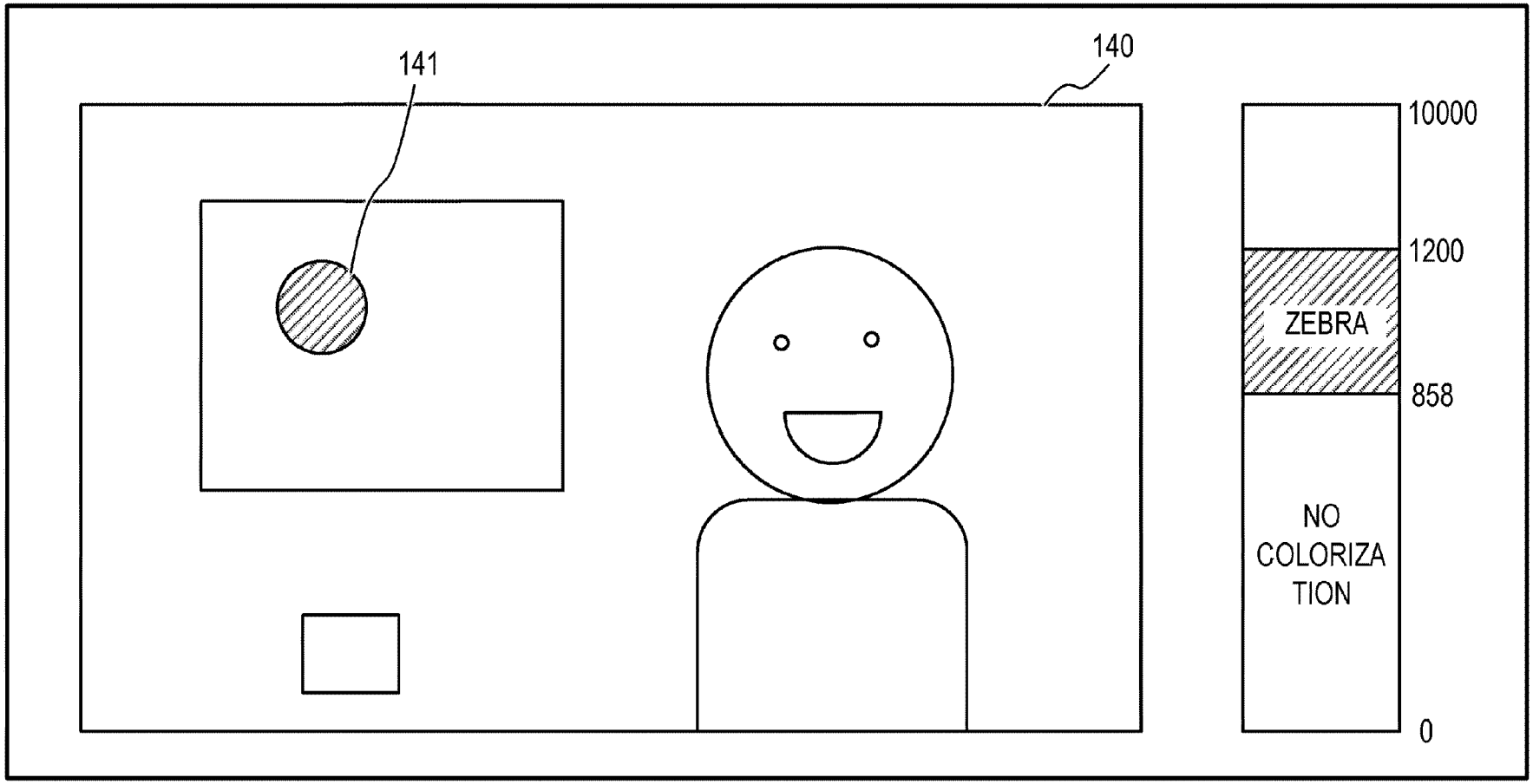
FIG. 6 is a diagram illustrating a display image according to the first embodiment.

Furthermore, in the present embodiment, it is possible to display a region (a collection of pixels) having brightness gradation values within the colorization brightness range with a zebra pattern, and display pixels having brightness gradation values outside the colorization brightness range without any colorization (i.e., in the original colors in the input image). FIG. 6 illustrates an example of a display in which pixels having brightness gradation values within the colorization brightness range are displayed with a zebra pattern, and pixels having brightness gradation values outside the colorization brightness range are displayed without colorization. In a display image 140, a region 141, which is a region of pixels having brightnesses of 858 to 1,200 cd/m$^2$, corresponding to brightness gradation values within the colorization brightness range, is displayed with a zebra pattern. Regions aside from the region 141 are displayed in colors corresponding to the pixel values of the input image (the colors in the input image). Note that the configuration may be such that when the user wishes to confirm the image within the colorization brightness range, the display can be switched between displaying regions (collections of pixels) having brightness gradation values within the colorization brightness range without colorization (the original colors of the input image) and displaying pixels having brightness gradation values outside the colorization brightness range with a zebra display.

Although the present embodiment describes the display control unit 106 determining the lower limit brightness gradation value of the colorization brightness range on the basis of the peak brightness information and the brightness distribution information, the lower limit brightness gradation value of the colorization brightness range may be determined on the basis of the peak brightness information only.

Here, when calculating the lower limit brightness gradation value using only the peak brightness information, the lower limit brightness gradation value is calculated in S1003, after which the sequence moves to S1006 without the processing of S1004 and S1005 being executed. In this case, a high-brightness region corresponding to a certain number (set number) of gradation values from the peak brightness gradation value (a predetermined width) can be colorized.

Although the present embodiment describes the display control unit 106 decrementing the lower limit brightness gradation value L_low until the percentage R becomes at least a threshold (1%, in the present embodiment), the lower limit brightness gradation value L_low may be decremented until the number of colorized pixels becomes a predetermined number. In other words, the display control unit 106 may determine the lower limit brightness gradation value L_low (the colorization brightness range) on a frame-by-frame basis so that at least a certain number (set number) of pixels are colorized in each frame of the input image. Note that this certain number may be the same number from frame to frame in the input image.

Additionally, although the present embodiment describes the colorization gradation width α (10, in the present embodiment), the threshold for the percentage of colorized pixels (1%, in the present embodiment), and so on as fixed values, these values may be values which are changed on the basis of setting values set through user operations.

FIG. 7 is a table illustrating an example of relationships between the colorization gradation width α and the threshold for the percentage of colorized pixels with respect to a colorization degree. FIG. 7 is an example of a table in which settings have been made for each of colorization degrees of −5 to +5 through user operations (i.e., settings for the colorization gradation width α and the threshold for the percentage of colorized pixels). From the table illustrated in FIG. 7, the display control unit 106 determines (changes) the colorization gradation width α and the threshold for the percentage of colorized pixels corresponding to the colorization degree selected (set) by the user. Then, the processing of the flowchart illustrated in FIG. 2 is executed using the determined colorization gradation width α and threshold for the percentage of colorized pixels as initial values. Doing so makes it possible for the user to adjust to the colorization brightness range as desired.

Second Embodiment

A display device 100 according to a second embodiment will be described. In the present embodiment, the display device 100 displays low-brightness regions in a colorized manner in accordance with information of a minimum brightness (and brightness distribution information) of the input image.

The configuration of the display device 100 according to the present embodiment is the same as the configuration of the display device 100 according to the first embodiment. Here, in the present embodiment, the processing performed by the information obtaining unit 102 and the display control unit 106 is different from that of the first embodiment, and thus the information obtaining unit 102 and the display control unit 106 will be described in detail hereinafter.

The information obtaining unit 102 generates a minimum brightness gradation value and a brightness distribution information as brightness information for each frame of an input image by analyzing each frame. The information obtaining unit 102 outputs the minimum brightness gradation value and the brightness distribution information to the display control unit 106 as the brightness information. Here, the "minimum brightness gradation value" is the minimum of the brightness gradation values of all the pixels in the frame. Additionally, although the information obtaining unit 102 obtains the brightness information, such as the minimum brightness gradation value, by analyzing the input image, the brightness information may instead be obtained from metadata added to the input image.

Figure 8:
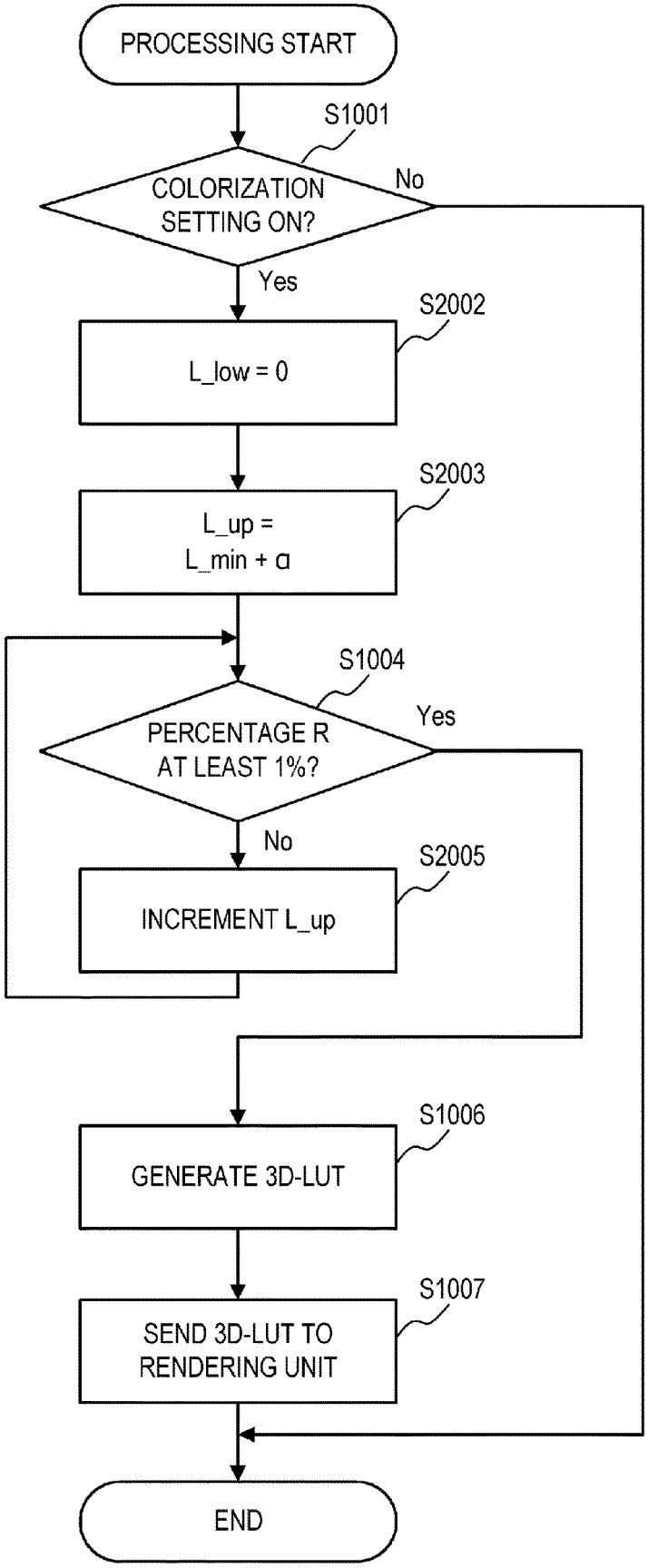
FIG. 8 is a flowchart illustrating processing for generating a 3D-LUT according to a second embodiment.

The display control unit 106 generates a 3D-LUT by performing the processing of the flowchart illustrated in FIG. 8.

3D-LUT Generation Processing

Processing through which the display control unit 106 generates the 3D-LUT according to the present embodiment will be described with reference to the flowchart in FIG. 8. Note that the display control unit 106 executes the respective steps of the processing in the flowchart illustrated in FIG. 8 by executing programs recorded into non-volatile memory (not shown). Although the following will describe only processing for generating a 3D-LUT for a target frame in the input image, the processing of the flowchart illustrated in FIG. 8 is performed on each frame of the input image. The processing of the flowchart illustrated in FIG. 8 starts upon the display control unit 106 obtaining, from the information obtaining unit 102, the minimum brightness gradation value and the brightness distribution information of the target frame. The processing of S1001, S1004, S1006, and S1007 is the same as the processing in the flowchart of FIG. 3, and will therefore not be described in detail.

In S1001, the display control unit 106 determines whether the colorization setting is "on" or "off". When the colorization setting is "on", the sequence moves to S2002, whereas when the colorization setting is "off", the processing of the flowchart ends.

In S2002, the display control unit 106 sets the lower limit brightness gradation value L_low to 0. Note that it is not necessary for the lower limit brightness gradation value L_low to be 0, and the lower limit brightness gradation value L_low may be set to any value not more than a minimum brightness gradation value L_min (not more than the minimum brightness gradation value).

In S2003, the display control unit 106 determines the upper limit brightness gradation value L_up on the basis of the minimum brightness gradation value L_min output from the information obtaining unit 102. In S2003, the display control unit 106 determines, as the upper limit brightness gradation value L_up, a value obtained by adding the colorization gradation width α to the minimum brightness gradation value L_min.

For example, when the minimum brightness gradation value L_min is 64 and the colorization gradation width α is 10, the upper limit brightness gradation value L_up is determined to be 74, on the basis of the following Equation 2.

$$L_up = L_min + \alpha = 64 + 10 = 74 \quad \text{Equation 2}$$

In S1004, the display control unit 106 determines whether or not the percentage R of the number of colorized pixels out of the total number of pixels in the target frame is at least 1%. The sequence moves to S2005 when the percentage R is not at least 1%. The sequence moves to S1006 when the percentage R is at least 1%.

In S2005, the display control unit 106 increments the upper limit brightness gradation value L_up by 1, i.e., adds 1 to the value.

In this manner, through the processing of S1004 and S2005, the upper limit brightness gradation value L_up is incremented until the percentage R becomes at least 1%. In the brightness distribution illustrated in FIG. 9, the percentage R becomes at least 1% when the upper limit brightness gradation value L_up reaches 118.

Through the processing of S2002, S2003, S1004, and S2005, the lower limit brightness gradation value L_low is determined as 0, and the upper limit brightness gradation value L_up is determined as 118. In other words, in the processing of S2002, S2003, S1004, and S2005, the display control unit 106 sets a colorization brightness range (setting range).

Figure 10A:
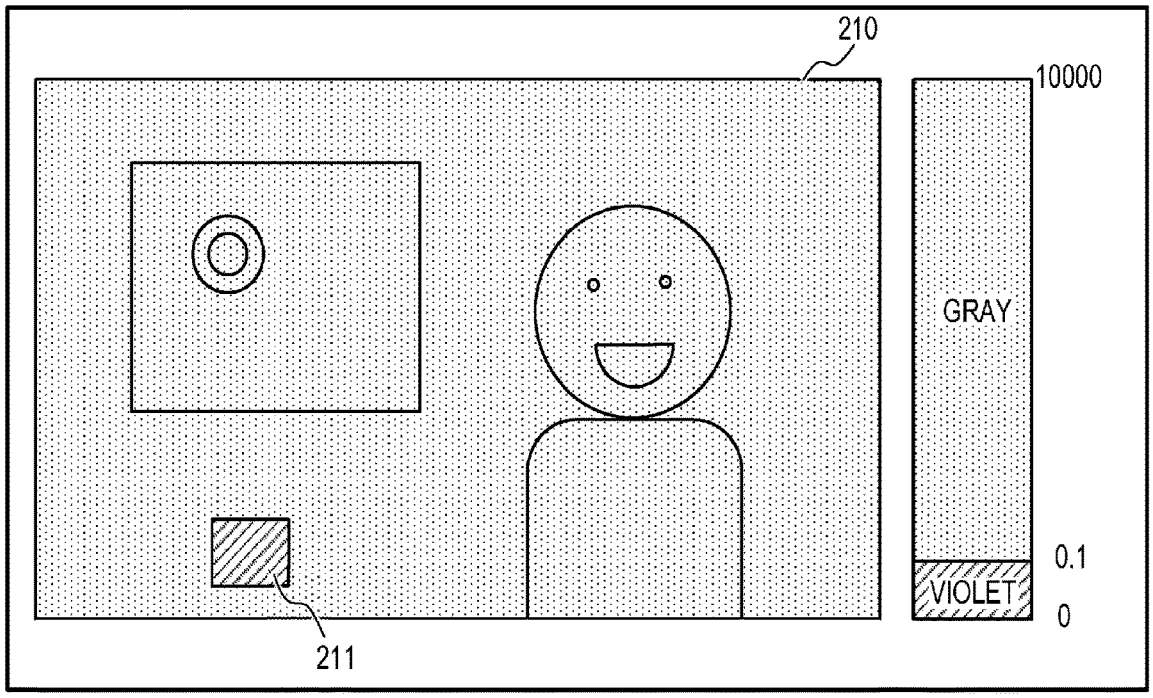
FIG. 10A is a diagram illustrating a display image according to the second embodiment.

FIG. 10A illustrates an example of the display of a display image 210 in which the target frame having the brightness distribution illustrated in FIG. 9 has been colorized as described in the present embodiment. In the display image 210, the pixels in a region 211 have brightness gradation values of from 0 to 118, which are within the colorization brightness range and which have equivalent brightnesses of from 0 to 0.1 cd/m and are therefore displayed in violet. The pixels outside the region 211 of the display image 210 are displayed in gray.

Although the present embodiment describes the display control unit 106 determining the upper limit brightness gradation value of the colorization brightness range on the basis of the minimum brightness gradation value and the brightness distribution information, the upper limit brightness gradation value of the colorization brightness range may be determined on the basis of the minimum brightness gradation value only.

Here, when calculating the upper limit brightness gradation value using only the minimum brightness gradation value, the upper limit brightness gradation value is calculated in S2003, after which the sequence moves to S1006 without the processing of S1004 and S2005 being executed. In this case, a low-brightness region corresponding to a certain number of gradation values from the minimum brightness gradation value (a predetermined width) can be colorized.

As described thus far, by calculating the colorization brightness range on the basis of the minimum brightness information and the brightness distribution information of a frame in the input image, and performing the colorization processing with a chromatic color only for low-brightness pixels in the frame, the user can intuitively ascertain low-brightness regions. Additionally, at least a certain number of pixels are colorized in the present embodiment as well, and it is therefore easy for the user to see the low-brightness regions.

Third Embodiment

A third embodiment will be described next. In the present embodiment, the display device 100 performs the colorization processing on pixels having brightness gradation values corresponding to a higher number of pixels, in accordance with the brightness distribution information. In the present embodiment, the display device 100 takes pixels for which the number of pixels having the same brightness gradation value in the target frame of the input image is at least a certain number, and displays those pixels in a different display appearance from pixels for which the number of pixels having the same brightness gradation value in the target frame is less than the certain number. Processing that is the same as that described in the first embodiment will not be described here.

Figure 11:
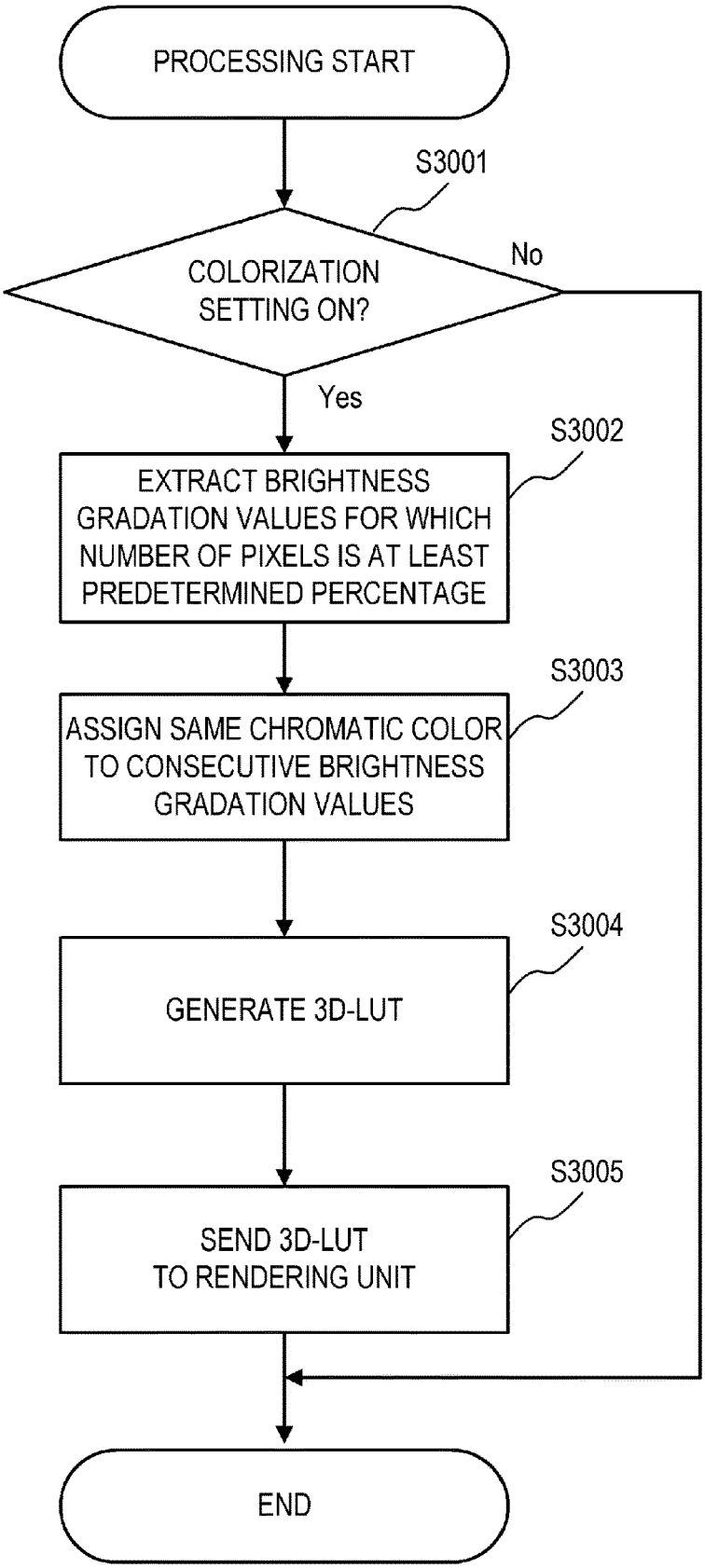
FIG. 11 is a flowchart illustrating processing for generating a 3D-LUT according to the third embodiment.

In the present embodiment, only the processing performed by the display control unit 106 is different from the first embodiment, and thus the processing performed by the display control unit 106 will be described with reference to the flowchart in FIG. 11. Note that the display control unit 106 executes the respective steps of the processing in the flowchart illustrated in FIG. 11 by executing programs recorded into non-volatile memory (not shown). Although the following will describe only processing for generating a 3D-LUT for a target frame in the input image, the processing of the flowchart illustrated in FIG. 1I is performed on each frame of the input image. The processing of the flowchart illustrated in FIG. 11 starts upon the display control unit 106 obtaining, from the information obtaining unit 102, the brightness distribution information of the target frame.

In S3001, the display control unit 106 obtains the colorization setting set through a user operation, and determines whether the colorization setting is "on" or 'off'. When the colorization setting is "on", the sequence moves to S3002, whereas when the colorization setting is "off", the processing of the flowchart ends.

In S3002, on the basis of the brightness distribution information output from the information obtaining unit 102, the display control unit 106 extracts the brightness gradation values of pixels for which a number of pixels having the same brightness gradation value is at least a predetermined percentage (e.g., at least 1% of the total number of pixels). When, for example, the resolution of the input image is 1,920×1,080, 1% of the total number of pixels is 1,920×1,080×0.01=20,736.

With the target frame having the brightness distribution illustrated in FIG. 12, the display control unit 106 extracts brightness gradation values of from 340 to 355 and from 472 to 479. This is because each of the brightness gradation values of from 340 to 355 and from 472 to 479 is in at least 20,736 pixels (1% of the total number of pixels).

In S3003, the display control unit 106 takes brightness gradation values, among the brightness gradation values extracted in S3002, which are consecutive as a single group, and assigns a different chromatic color to each group. For example, the display control unit 106 assigns green to the brightness gradation values of from 340 to 355, and assigns yellow to the brightness gradation values of from 472 to 479.

In S3004, the display control unit 106 generates the 3D-LUT. Here, the 3D-LUT is a table that converts the colors of pixels having brightnesses corresponding to the brightness gradation values extracted in S3002 into the chromatic colors assigned in S3003, and converts the colors of pixels having brightnesses corresponding to brightness gradation values not assigned chromatic colors to gray.

In S3005, the display control unit 106 outputs the 3D-LUT to the rendering unit 104.

Figure 10B:
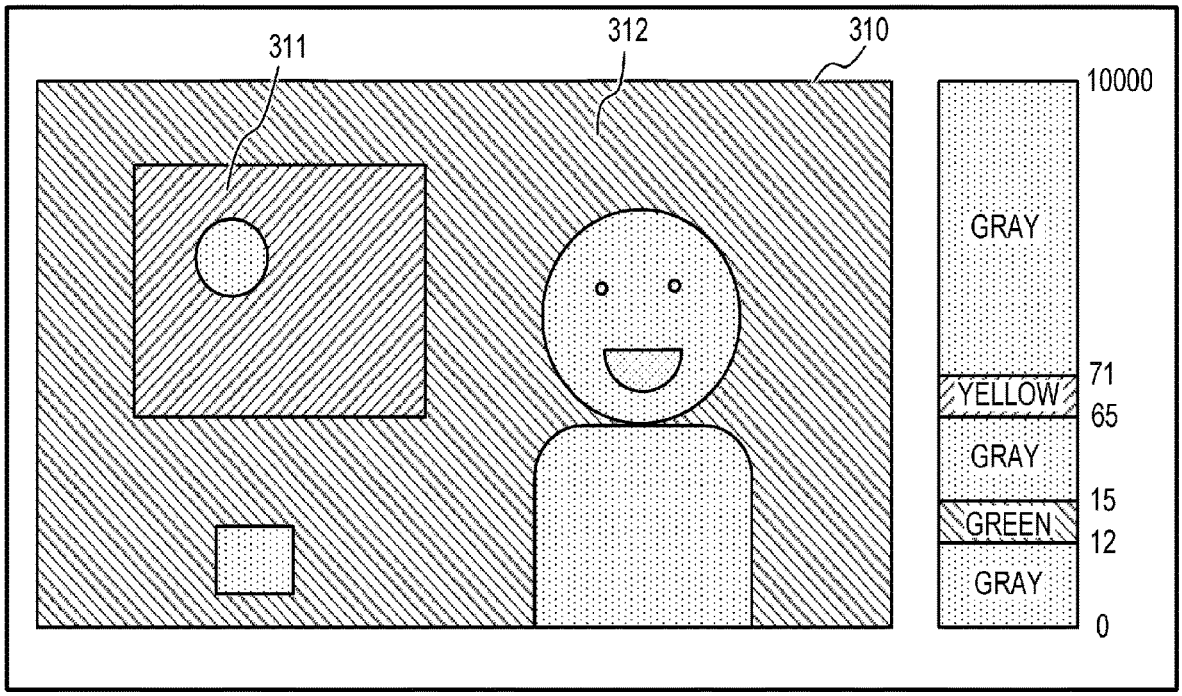
FIG. 10B is a diagram illustrating a display image according to a third embodiment.

FIG. 10B illustrates an example of the display of a display image 310 in which the target frame having the brightness distribution illustrated in FIG. 12 has been colorized. In the display image 310, the pixels in a region 311 have brightness gradation values of from 472 to 479, which are equivalent brightnesses of from 65 to 71 cd/m$^2$, and these pixels are therefore displayed in yellow. The pixels in a region 312 have brightness gradation values of from 340 to 355, which are equivalent brightnesses of from 12 to 15 cd/m$^2$, and these pixels are therefore displayed in green. In the display image 310, the pixels outside these regions are displayed in gray.

As described thus far, on the basis of the brightness distribution information of the input image, pixels having brightness gradation values corresponding to a number of pixels that is at least a predetermined percentage of the total number of pixels are colorized with chromatic colors. Through this, the user can intuitively ascertain whether or not there is an imbalance in the brightness, as well as regions where an imbalance in the brightness has arisen.

According to the present invention, a user can easily ascertain relatively high-brightness regions, low-brightness regions, and so on in an image.

Although the foregoing has described preferred embodiments of the present invention, the present invention is not intended to be limited to the specific embodiments, and all variations that do not depart from the essential spirit of the invention are intended to be included in the scope of the present invention. Furthermore, the above-described embodiments are merely embodiments of the present invention, and different embodiments can be combined as appropriate. The embodiments can also be realized as a display control device in which the display unit 105 of the display device 100 is not included, and an external display device is controlled instead.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-005072, filed on Jan. 16, 2020, which is hereby incorporated by reference herein in its entirety.

What is claimed is:

1. A display device comprising:

a display;

at least one memory; and at least one processor, the at least one processor executing instructions to:

obtain an image of one frame of a moving image, and perform control such that a pixel having a brightness gradation value that is included within a setting range, which is a colorization brightness range of brightness gradation values, and which is a range set to include at least a predetermined minimum percentage of at least one percent of a total number of pixels in a target frame of the image, is colorized in the display in a display appearance, and a pixel having a brightness gradation value that is not included within the setting range in the target frame is not colorized, wherein the at least one processor determines a particular setting range for each frame of the moving image, such that the predetermined minimum percentage of colorized pixels in the target frame is the same among frames of the image.

2. The display device according to claim 1, wherein the at least one processor 1) obtains brightness information of the target frame; and 2) based the brightness information, determines the setting range so that a number of pixels having brightness gradation values included within the setting range is at least the predetermined minimum percentage of at least one percent of the total number of pixels in the target frame.

3. The display device according to claim 1, wherein the brightness information of the target frame includes distribution information indicating a number of pixels for each of brightness gradation values in the target frame, and the at least one processor determines the setting range, based on the distribution information.

4. The display device according to claim 1, wherein the at least one processor 1) obtains brightness information of the target frame of the image, and 2) based on the brightness information, determines the setting range, which is the range of colorization brightness gradation values and which is a range having a width greater than or equal to a predetermined width.

5. The display device according to claim 1, wherein the brightness information of the target frame includes information of a maximum brightness gradation value in the target frame, and the at least one processor determines an upper limit value of the setting range to a value that is greater than or equal to the maximum brightness gradation value.

6. The display device according to claim 1, wherein the at least one processor displays, in the display, the minimum predetermined percentage of pixels of at least one percent of the total number of pixels having a brightness gradation value that is included within the setting range in the target frame in a chromatic color, and displays each pixel having a brightness gradation value that is not included within the setting range in an achromatic color.

7. The display device according to claim 6, wherein the at least one processor displays each respective pixel having a brightness gradation value that is included within the setting range in the target frame, in the display, in a respective chromatic color in accordance with the brightness gradation value corresponding to the respective pixel.

8. The display device according to claim 1, wherein the at least one processor displays in a predetermined pattern, in the display, a region constituted of pixels having a brightness gradation value that is included within the setting range in the target frame.

9. The display device according to claim 8, wherein the predetermined pattern is a stripe pattern or a pattern in which a plurality of graphics are arranged.

10. The display device of claim 1, wherein setting the setting range includes calculating an initial percentage of pixels to be colorized based on an upper limit brightness gradation value and an initial lower limit brightness gradation value, and reducing the initial lower limit value when the calculated initial percentage is less than the predetermined minimum percentage.

11. A control method of a display device including a display, the method comprising:

an image obtaining step of obtaining an image of one frame of a moving image, and a display step of colorizing and displaying in the display a pixel having a brightness gradation value that is included within a setting range, which is a colorization brightness range of brightness gradation values, and which is a range set to include at least a predetermined minimum percentage of at least one percent of a total number of pixels in a target frame of the image, in a display appearance, wherein each pixel having a brightness gradation value that is not included within the setting range in the target frame is not colorized, and determining a particular setting range for each frame of the moving image such that the predetermined minimum percentage of colorized pixels in the target frame is the same among frames of the image.

12. A control method according to claim 11, further comprising:

an information obtaining step of 1) obtaining brightness information of the target frame of the image, and based on the brightness information, determining the setting range, which is the range of brightness gradation values and which is a range having a width greater than or equal to a predetermined width.

13. A computer-readable non-transitory storage medium storing therein a program for causing a computer to execute the steps of the control method according to claim 11.

14. A computer-readable non-transitory storage medium storing therein a program for causing a computer to execute the steps of the control method according to claim 12.

* * * * *